US008567411B2

(12) United States Patent
Demmer et al.

(10) Patent No.: US 8,567,411 B2
(45) Date of Patent: Oct. 29, 2013

(54) SYSTEM FOR SELF-ASSEMBLY OF CIGARETTES

(75) Inventors: Udo Demmer, Pinneberg (DE); Reto Diederichs, Seevetal (DE); Holger Fleischhauer, Hamburg (DE); Henning Seidel, Mechtersen (DE)

(73) Assignee: Reemtsma Cigarettenfabriken GmbH, Hamburg (DE)

( * ) Notice: Subject to any disclaimer, the term of this patent is extended or adjusted under 35 U.S.C. 154(b) by 679 days.

(21) Appl. No.: 12/375,403

(22) PCT Filed: Apr. 18, 2007

(86) PCT No.: PCT/EP2007/003401

§ 371 (c)(1),
(2), (4) Date: Jul. 17, 2009

(87) PCT Pub. No.: WO2008/011923

PCT Pub. Date: Jan. 31, 2008

(65) Prior Publication Data

US 2010/0012136 A1 Jan. 21, 2010

(30) Foreign Application Priority Data

Jul. 27, 2006 (DE) ..... 10 2006 035 276

(51) Int. Cl.
*A24C 5/00* (2006.01)

(52) U.S. Cl.
USPC ..... 131/70; 131/58

(58) Field of Classification Search
USPC ..... 131/70–73, 58
See application file for complete search history.

(56) References Cited

U.S. PATENT DOCUMENTS

| | | | | |
|---|---|---|---|---|
| 1,785,294 | A * | 12/1930 | Calvird | 206/92 |
| 2,551,095 | A * | 5/1951 | Chaze | 222/162 |
| 2,625,937 | A | 1/1953 | Sperry | |
| 2,668,545 | A | 2/1954 | Burnsteiin | |
| 2,731,971 | A | 1/1956 | Kastner | |

(Continued)

FOREIGN PATENT DOCUMENTS

| | | |
|---|---|---|
| DE | 3605052 A1 | 8/1987 |
| DE | 3914669 A1 | 11/1990 |

(Continued)

*Primary Examiner* — Richard Crispino
*Assistant Examiner* — Dionne Walls Mayes
(74) *Attorney, Agent, or Firm* — Hovey Williams LLP

(57) ABSTRACT

A system for self-assembly of cigarettes includes a stuffing device (50) and a tobacco package (1). The tobacco package (1) has a first end side (2) and a second end side (3), and comprises on both end sides (2, 3) a cover that protrudes for the distance. The tobacco package (1) is filled with tobacco (6). The stuffing device (50) comprises a pressing chamber (54) having a longitudinal direction, into which the tobacco (6) can be filled via a longitudinal filling opening (56), the tobacco being able to be formed into a tobacco strand by means of a pressing bar (58) that can be moved laterally to the longitudinal direction of the pressing chamber (54), and a pushing device (62) that can be transferred from the pressing chamber (54) into a cigarette paper wrap disposed in front of the pressing chamber (54) by means of a sliding device (62) that can be moved in a longitudinal direction of the pressing chamber (54). The tobacco package (1) is inserted with its second end side (3) in front such that the second end side (3) of the tobacco package (1) is disposed above the filling opening (56) of the pressing chamber (54).

30 Claims, 5 Drawing Sheets

(56) References Cited

U.S. PATENT DOCUMENTS

Figure 5:
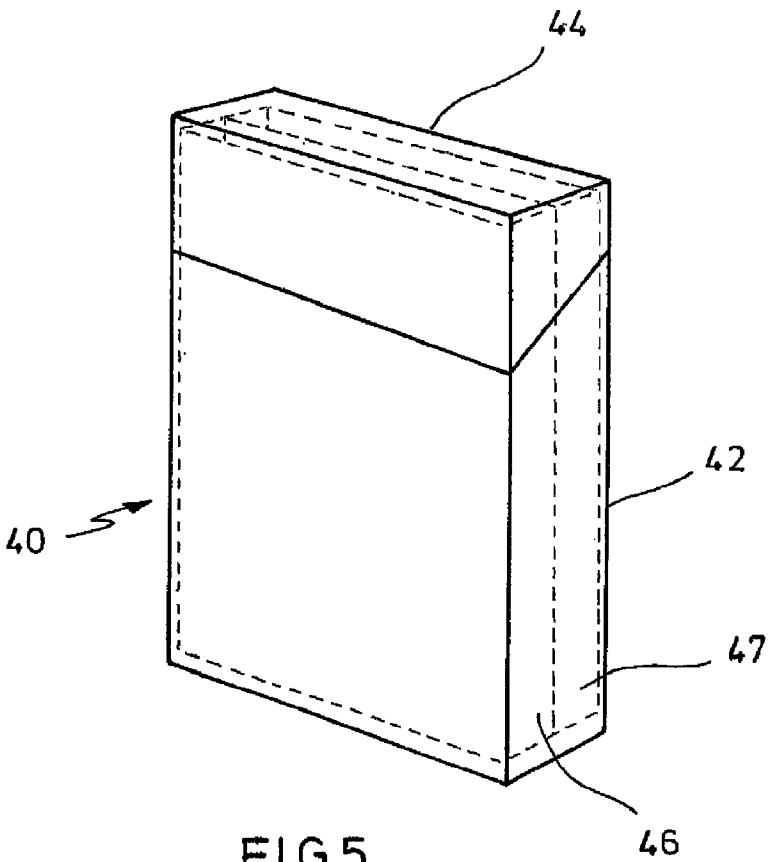

| | | | | |
|---|---|---|---|---|
| 3,127,900 | A | 4/1964 | Kastner | |
| 3,693,630 | A | 9/1972 | Kastner | |
| 4,411,278 | A | 10/1983 | Kastner | |
| 5,526,825 | A * | 6/1996 | Ruppert et al. | 131/70 |
| 2004/0099277 | A1 | 5/2004 | Moser | |
| 2006/0191807 | A1 * | 8/2006 | Dierken et al. | 206/242 |
| 2008/0216847 | A1 * | 9/2008 | Demmer et al. | 131/70 |

FOREIGN PATENT DOCUMENTS

| | | | |
|---|---|---|---|
| DE | 10129260 | C1 | 10/2002 |
| EP | 0178605 | A1 | 10/1985 |
| EP | 0584805 | A1 | 3/1994 |
| EP | 0647411 | A1 | 4/1995 |
| FR | 349576 | A | 6/2005 |
| GB | 590126 | A | 7/1947 |
| WO | WO2005/037668 | * | 4/2005 |
| WO | WO 2005/104881 | * | 11/2005 |

* cited by examiner

SYSTEM FOR SELF-ASSEMBLY OF CIGARETTES

CROSS-REFERENCE TO RELATED APPLICATIONS

This is a National Phase Application pursuant to 37 C.F.R. §371 of International Application No. PCT/EP2007/003401, filed Apr. 18, 2007, claiming priority from German Application No. DE 10 2006 035 276.9, filed Jul. 26, 2006, the entire disclosures of which are hereby incorporated by reference herein.

BACKGROUND OF THE INVENTION

1. Field of the Invention

The invention relates to a system for self-assembly of cigarettes, having a stuffing device and a tobacco pack, and to a corresponding stuffing device and to a corresponding tobacco pack.

2. Discussion of the Prior Art

The simplest way, as far as the equipment used is concerned, of assembling a cigarette oneself is to "roll" a cigarette using loose tobacco, a cigarette-paper sheet, which is adhesively bonded along a longitudinal seam once a cigarette strand has been formed, and possibly using a filter. Even if straightforward auxiliary means are used, this method for self-assembly of cigarettes is laborious for the user and leads to the surroundings being contaminated by pieces of tobacco.

Numerous devices have been devised over time in order to facilitate the self-assembly of cigarettes. A recent example of such a device is disclosed in US 2004/0099277 A1. Here, loose tobacco is poured into a hopper-like storage magazine, measured, compressed in a pressing chamber and conveyed into a prefabricated cigarette-paper tube. Although this device is convenient in principle it involves high outlay and operates with loose tobacco, which is associated with the risk of contamination.

EP 0 584 805 B1 describes a device which is intended for self-assembly of a cigarette and which makes use of pre-divided smoking tobacco. The tobacco portions provided for a respective cigarette either have a respective wrapper, in which case they are connected adjacent to one another in a rod-like manner to form a block, or they are enclosed by a common wrapper to form a block. These wrappers consist of highly porous material which can be smoked as well. In the device, such a block is inserted with a longitudinal side in front into a magazine which is arranged above the introduction opening of a pressing chamber. By virtue of pressure being applied to the block, the respectively lowermost tobacco portion is conveyed into the pressing chamber, where, after being cut off from the rest of the block with the aid of a cutting blade, it is formed into a tobacco strand by a pressing bar which can be moved in the transverse direction. This tobacco strand is then pushed, by means of a pushing-action mechanism out of the pressing chamber and into a cigarette-paper tube arranged upstream of the pressing chamber. The disadvantage here is that the porous wrapping material, which is likewise severed by the cutting blade, also passes into the cigarette-paper tube. Furthermore, the wrapping material is loose enough for it likewise easily to result in contamination if it is not used quite correctly.

A similarly designed device for self-assembly of cigarettes is known from U.S. Pat. No. 2,731,971, from U.S. Pat. No. 3,127,900 and from U.S. Pat. No. 4,411,278. In these cases, however, loose tobacco is poured directly into the introduction opening of the pressing chamber. The cutting blade is connected rigidly to the pressing bar, but precedes the latter. If the user pivots an actuating lever, which a mechanism connects to the pressing bar and the cutting element and to the pushing-action mechanism, the cutting element cuts off excess tobacco and closes the pressing chamber on the top side, while the pressing bar then compresses the tobacco and the resulting tobacco strand, finally, is transferred by the pushing-action mechanism into a cigarette-paper tube plugged onto an attachment neck upstream of the pressing chamber. According to U.S. Pat. No. 4,411,278 the pushing-action mechanism is designed as an elongate tongue. This device, once again, has the disadvantage of the risk of contamination, and the task of introducing the loose tobacco for each individual cigarette is a laborious one.

EP 0 178 605 B1 and DE 39 14 669 C2, for example, describe devices and methods for self-assembly of cigarettes in which the tobacco intended for smoking is pre-divided in the form of tobacco cartridges. The tobacco here is enclosed by a non-smokeable sheath. In order to make a cigarette, the tobacco is transferred from the tobacco cartridge into a cigarette-paper tube, in which case the sheath of the tobacco cartridge is left behind. DE 101 29 260 C1 discloses an easy-to-handle stuffing device with the aid of which the tobacco can be transferred from such a tobacco cartridge into a cigarette-paper tube. In the case of these known systems, the waste, on account of the sheaths of the individual tobacco cartridges, is disadvantageous.

SUMMARY

It is an object of the invention to provide a possibility for self-assembly of cigarettes which is user-friendly, does not give rise to any, or any significant amount of, contamination from pieces of tobacco and results in as little waste as possible.

This object is achieved by a system for self-assembly of cigarettes including a stuffing device and a tobacco pack. A stuffing device for such a system, including a pressing chamber, a pressing bar, a pushing-action mechanism, and a holder is also disclosed, as is a tobacco pack for such a system. Advantageous configurations of the invention, including details of construction, are also disclosed.

The system according to the invention for self-assembly of cigarettes has a stuffing device and a tobacco pack. The tobacco pack has a first end side and a second end side and is provided, on the first end side, with a removable first covering, which is designed for removal, and, on the (opposite) second end side, with a removable second covering, which is designed for removal. The tobacco pack is filled with tobacco, preferably fine-cut tobacco.

Fine-cut tobacco is defined in §2, section 4 of the German tobacco tax law dated Dec. 21, 1992 (Federal Law Gazette I page 2150), last amended by the Ordinance dated Jul. 10, 2006 (Federal Law Gazette I page 1473): "Smoking tobacco is considered to be fine-cut tobacco if more than 25 percent by weight of the tobacco particles are less than 1 mm in length or width."

The stuffing device has a pressing chamber with a longitudinal direction, into which tobacco can be introduced via a longitudinally oriented introduction opening. The tobacco, by means of a pressing bar which can be moved transversely to the longitudinal direction of the pressing chamber, can be formed into a tobacco strand and, by means of a pushing-action mechanism which can be moved in the longitudinal direction of the pressing chamber, can be transferred out of the pressing chamber into a cigarette-paper tube arranged upstream of the pressing chamber. Also provided is a holder into which a tobacco pack of the type mentioned above can be inserted with its second end side in front. In the inserted state, the second end side of the tobacco pack is arranged above the introduction opening of the pressing chamber.

The stuffing device of the system according to the invention is constructed in a manner similar to the devices described in EP 0 584 805 B1, in U.S. Pat. No. 2,731,971, in U.S. Pat. No. 3,127,900 and in U.S. Pat. No. 4,411,278. However, rather than use being made of loose tobacco or tobacco which is pre-divided with the aid of porous wrappers, the tobacco is supplied into tobacco packs, preferably of cuboidal basic shape, which are easy to open on two end sides, i.e. on the first end side and on the second end side.

A possible way of using the system in which virtually no pieces of tobacco are dispersed into the surroundings consists in the user in the first instance opening a tobacco pack on the second end side and then inserting it into the holder, in which case the open second end side of the tobacco pack ends up located above the introduction opening of the pressing chamber. The user here can hold the stuffing device in a tilted state, in which case the tobacco pack is oriented essentially horizontally and no tobacco is lost via the open second end side. When the stuffing device is in its erected use position again, the user can open the first end side of the tobacco pack. Loose tobacco is then located above the introduction opening of the pressing chamber. Via the open first end side, the user can apply pressure to the tobacco and thus advance tobacco into the pressing chamber. Using the tobacco contained in the tobacco pack, a number of cigarettes can be made one after the other by virtue of the stuffing device being actuated. Finally, the tobacco pack is empty and can be removed from the holder.

The system according to the invention provides the tobacco, without unnecessary apportioning material being required, in a tobacco pack which serves, at the same time, as a magazine for the stuffing device. There is no need for the tobacco to be transferred from one container into another, this operation being associated with contamination by pieces of tobacco. With the aid of the stuffing device, the tobacco of a tobacco pack can be used straightforwardly and cost-effectively to make a relatively large number of cigarettes. The system according to the invention for self-assembly of cigarettes is therefore user-friendly, clean and generates little waste.

In the case of preferred embodiments of the invention, the stuffing device has a moveable cutting element, preferably a cutting blade, which is arranged on the introduction opening of the pressing chamber and by means of which tobacco penetrating through the introduction opening can be severed during movement, preferably a displacement movement, and the introduction opening can then optionally be closed. The movements of the cutting element and of the pressing bar are preferably coupled here. The stuffing device may have a moveable actuating element, preferably a pivoting lever, which is operatively connected, via an actuating mechanism, to the cutting element, the pressing bar and the pushing-action mechanism. Upon an actuating movement, the cutting element severs the tobacco penetrating through the introduction opening, the pressing bar forms the tobacco located in the pressing chamber into a tobacco strand, and the pushing-action mechanism transfers the tobacco strand into a cigarette-paper tube arranged upstream of the pressing chamber. In the case of the stuffing devices according to EP 0 584 805 B1, U.S. Pat. Nos. 2,731,971, 3,127,900 and 4,411,278 the tobacco strand is comparably formed and transferred into a cigarette-paper tube. With the aid of the actuating element, the user can operate the stuffing device straightforwardly, reliably and quickly.

The cigarette-paper tube can preferably be plugged onto an attachment neck arranged on the stuffing device upstream of the pressing chamber. It is also possible to provide a clamping or retaining mechanism to fasten the cigarette-paper tube on the attachment neck.

It is possible for the pushing-action mechanism of the stuffing device to be configured as a plunger by means of which the ready formed tobacco strand is forced out of the pressing chamber. However, this may give rise to further, undesirable compaction along with increased frictional forces. A preferred alternative is therefore a pushing-action mechanism with a tongue which is formed in a channel-like manner, is arranged opposite the pressing bar and extends preferably over the length of the pressing chamber. The tongue thus has a concave shape directed toward the tobacco, which can be supplemented, by the preferably likewise concave pressing bar, to give a largely circular shape when the pressing bar is moved all the way up to the tongue. When the tongue is advanced, it carries the tobacco along with it without compacting it any further. The tongue may be provided with teeth along its edge. Such tongues are known in the case of stuffing devices.

In the case of particularly preferred embodiments of the invention, the stuffing device has a slide which, via the first end side of a tobacco pack inserted into the holder, can be pushed into the tobacco pack. The slide is designed for advancing the tobacco in the tobacco pack, e.g. by virtue of the fact that its surface which butts against the tobacco is slightly smaller than the cross-sectional surface area of the tobacco pack. Although it is possible, in principle, for the user to move the tobacco forward in the direction of the pressing chamber using a temporary tool, this operation is made much easier by a slide which is supplied with the stuffing device.

Numerous configurations are conceivable for the slide. In the case of one embodiment, the slide has a relatively high weight, in which case it presses automatically onto the tobacco. Markings on the slide may be practical in order to read off the residual quantity of tobacco contained in the tobacco pack. In the case of a useful embodiment, the slide contains an accommodating space for a tobacco pack and can be inserted into the stuffing device, the slide preferably being configured as a drawer which can be inserted and removed. Such an embodiment allows the user to carry along a tobacco pack in the stuffing device at all times.

It has been explained above how the user can insert a tobacco pack into the holder, without pouring tobacco out of the already opened second end side of the tobacco pack, by tilting the stuffing device. In the case of heavy stuffing devices in particular, this is inconvenient. Therefore, in the case of an advantageous embodiment, the holder is mounted in a pivotable manner on the stuffing device and can be pivoted from a horizontal loading position into the use state. When the holder is horizontal, the user can introduce the tobacco pack, even with the second end side open, without pieces of tobacco escaping from the tobacco pack to any significant extent in the process. As soon as the tobacco pack has been inserted, the user pivots the holder into the use state, in which the second end side of the tobacco pack is arranged above the introduction opening of the pressing chamber. If the stuffing device has a closure mechanism, e.g. a closure slide, which can be moved from a closed state into an open state and, in the closed state, covers the second end side of a tobacco pack inserted into the holder, it is also the case that it is not possible for any tobacco to escape during pivoting of the holder from the loading position into the use state.

The holder preferably has a shaft into which a tobacco pack can be inserted with its second end side in front. The height of the shaft here is preferably less than the length of a tobacco pack inserted into the shaft, in which case the tobacco pack can easily be gripped as it is inserted into the holder and removed therefrom.

As already mentioned, the tobacco pack preferably has a cuboidal basic shape. This includes deviations from a precise cuboid, e.g. configurations with rounded edges or corners.

In the case of preferred embodiments of the invention, the thickness of the tobacco pack is coordinated with the width of the introduction opening in the stuffing device. For the purposes of this terminology, the thickness of the tobacco pack extends transversely to the longitudinal direction of the pressing chamber when the tobacco pack has been inserted into the holder. The width of the tobacco pack then runs in the longitudinal direction of the pressing chamber and the length runs in the direction of the height of the holder. The width of the introduction opening runs transversely to the longitudinal direction of the pressing chamber. The thickness of the tobacco pack is preferably 1 to 1.5 times the width of the introduction opening. If the thickness of the tobacco pack is not greater, or not much greater, than the width of the introduction opening, the transfer of the tobacco out of the tobacco pack into the pressing chamber does not cause any blocking action above the introduction opening, which could result in undesirable compaction of the tobacco, in increased friction and in problems in transferring the tobacco into the pressing chamber. The thickness of the tobacco pack is preferably only slightly greater than the width of the introduction opening, a narrow protrusion on the introduction opening serving as a stop for the tobacco pack.

The introduction opening of the stuffing device preferably has a width which is comparable to the diameter of a ready stuffed cigarette. If the introduction opening were too wide, the tobacco would be overly compressed during movement of the pressing bar. In the case of the preferred configuration explained, the tobacco pack preferably has a thickness which is considerably less than the thickness of a conventional cigarette pack. It is thus possible for two tobacco packs to be provided with common outer packaging which approximately has the dimensions of a conventional cigarette pack as well as, for example, a hinge lid. Such outer packaging can subsequently be used, for example, following removal of the two tobacco packs, for storing the self-assembled cigarettes.

The tobacco pack may be produced from conventional pack materials such as paperboard, cardboard, plastic or metal (e.g. aluminum, in particular in sheet form). Composite materials are likewise conceivable. It is advantageous to have a friction-reducing coating on the inside of the tobacco pack, in order for it to be possible for the tobacco to be transferred more easily into the pressing chamber. The same effect is achieved if the basic material of the tobacco pack already has a low level of static and/or sliding friction in relation to tobacco. In order to keep the tobacco fresh, the tobacco pack preferably has a diffusion-inhibiting coating on its inside, in particular if the basic material of the tobacco pack has open cells. It is possible here for a friction-reducing and a diffusion-inhibiting coating to be identical, e.g. in the case of a coating with polyethylene.

There are numerous possible ways of designing the tobacco pack such that the first covering and the second covering can be removed, to be precise preferably easily removed, from the first end side and the second end side, respectively. The two end sides are usually (but not necessarily) the narrow sides of a cuboidal basic shape.

It is thus possible, in the case of the tobacco pack, for the first covering and/or the second covering to be connected via predetermined tearing points to sides of the tobacco pack which are located between the first end side and the second end side. The predetermined tearing points preferably have at least one perforation line.

In the case of another possibility, the tobacco pack has a basic body which preferably contains cardboard. This basic body is open on the first end side and/or on the second end side, wherein the first covering and/or second covering provided is a sheet-material insert which is pushed into the basic body. The sheet-material insert preferably has aluminum. Mixed forms, in which the one end side is provided with the perforation lines explained and the other end side is provided with a sheet-material insert, are likewise conceivable.

Outer packaging may also serve as the first covering and/or as the second covering if the tobacco pack has a basic body which is open on the first end side and/or on the second end side. The outer packaging explained above, which is intended for accommodating two flat tobacco packs, may be provided in addition in the case of such a configuration.

The tobacco in the tobacco pack may be pre-divided, e.g. by the tobacco in the tobacco pack being formed into a block which, parallel to the second end side, between two portions in each case, has a predetermined weakening point, preferably notching. Such pre-division makes it easier to cut off a respective tobacco portion once it has been introduced into the pressing chamber through the introduction opening.

The tobacco in the tobacco pack is preferably fine-cut tobacco. If the tobacco has short fibers, it is easier to move into the pressing chamber from the tobacco pack. Preferably up to a proportion of more than 20% by weight of the tobacco has a fiber length of less than 2 mm.

BRIEF DESCRIPTION OF THE DRAWING FIGURES

Figure 1:
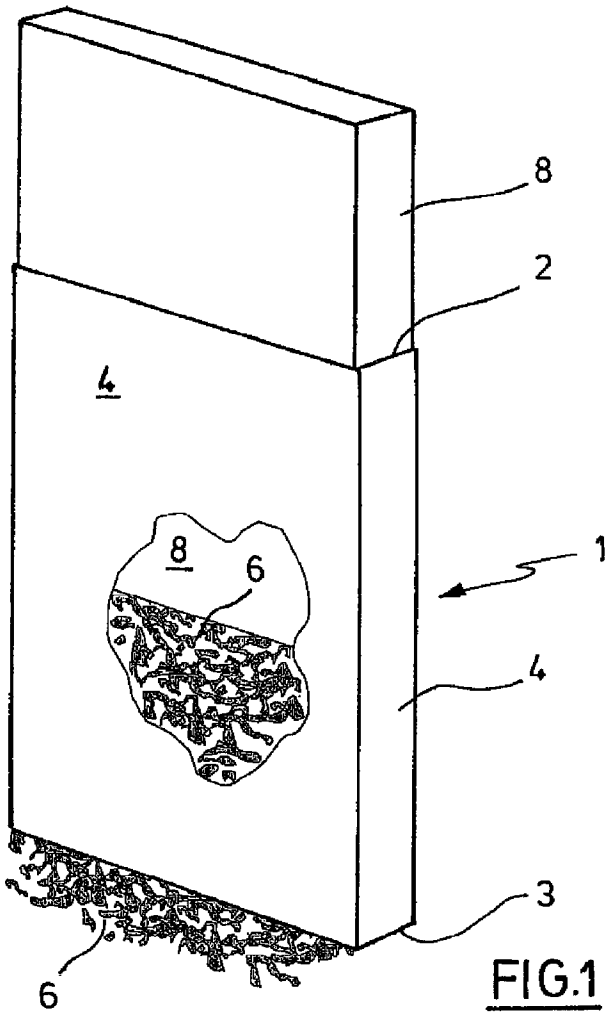
Figures 2, 3, 4:
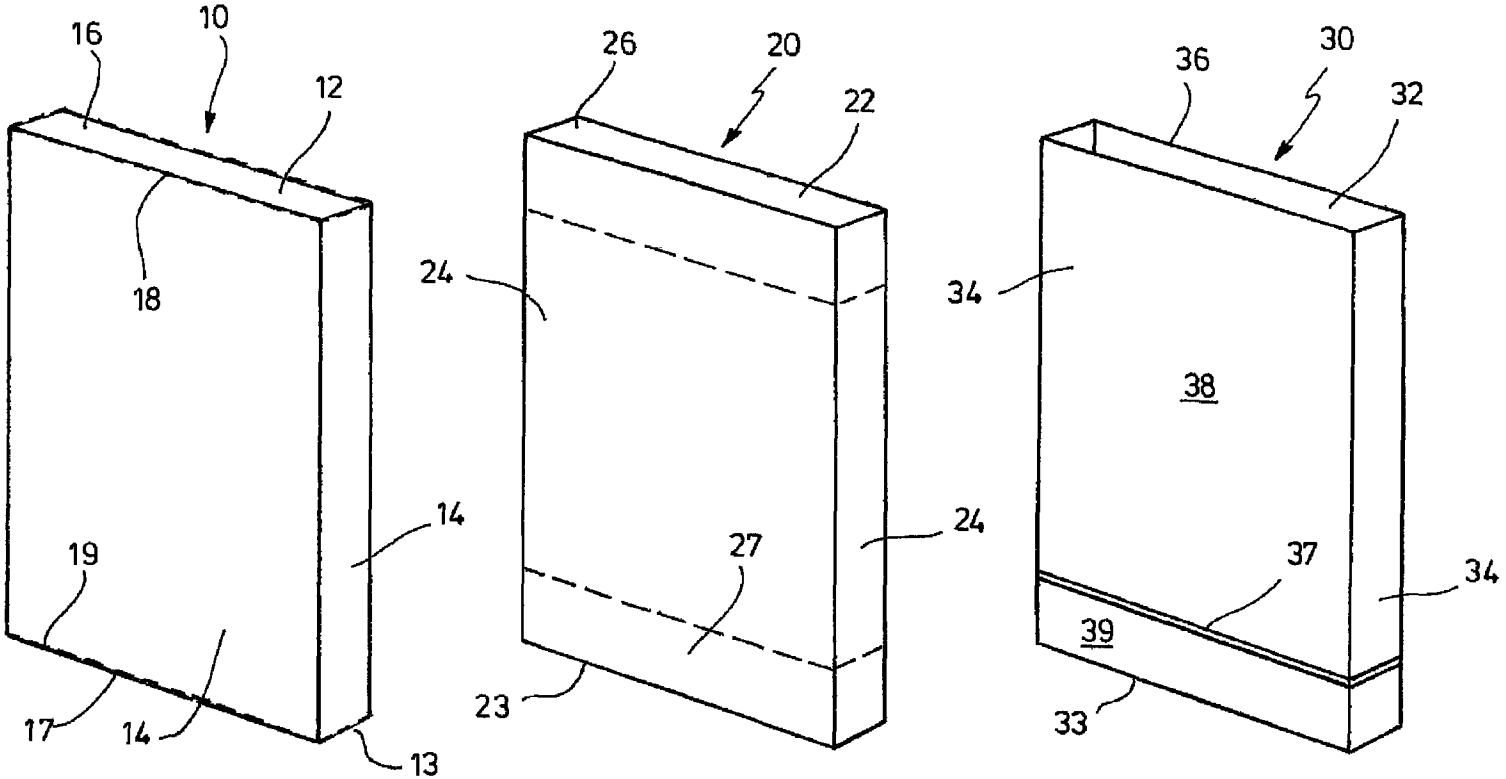
Figure 6A:
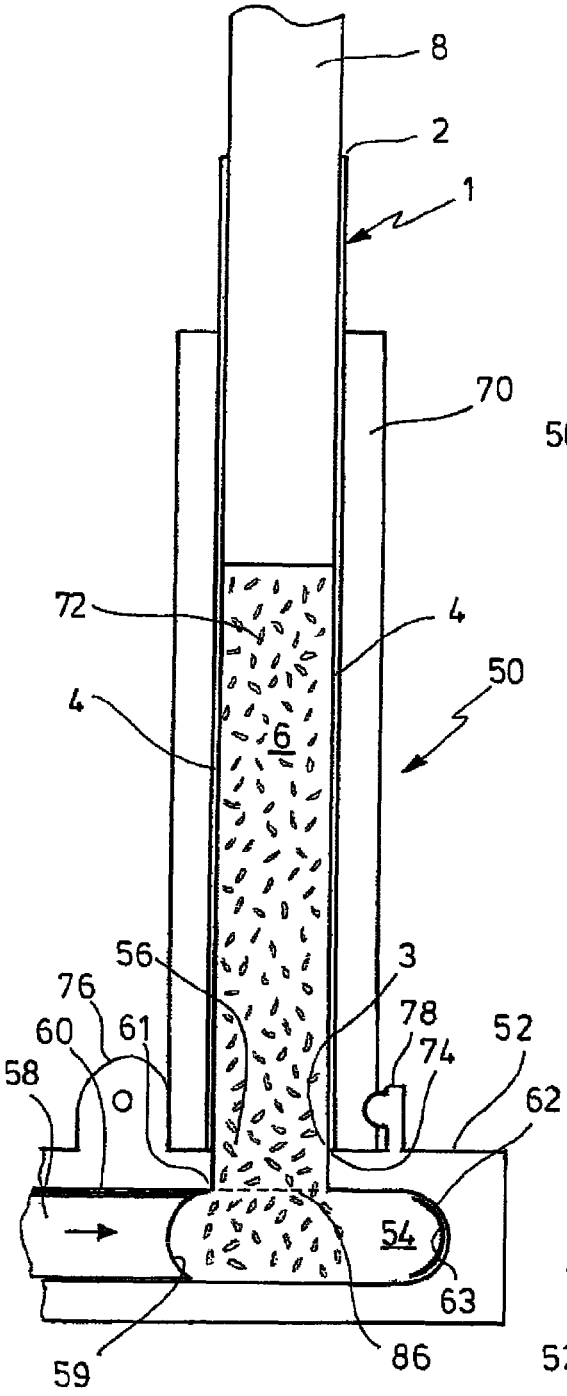
Figure 6B:
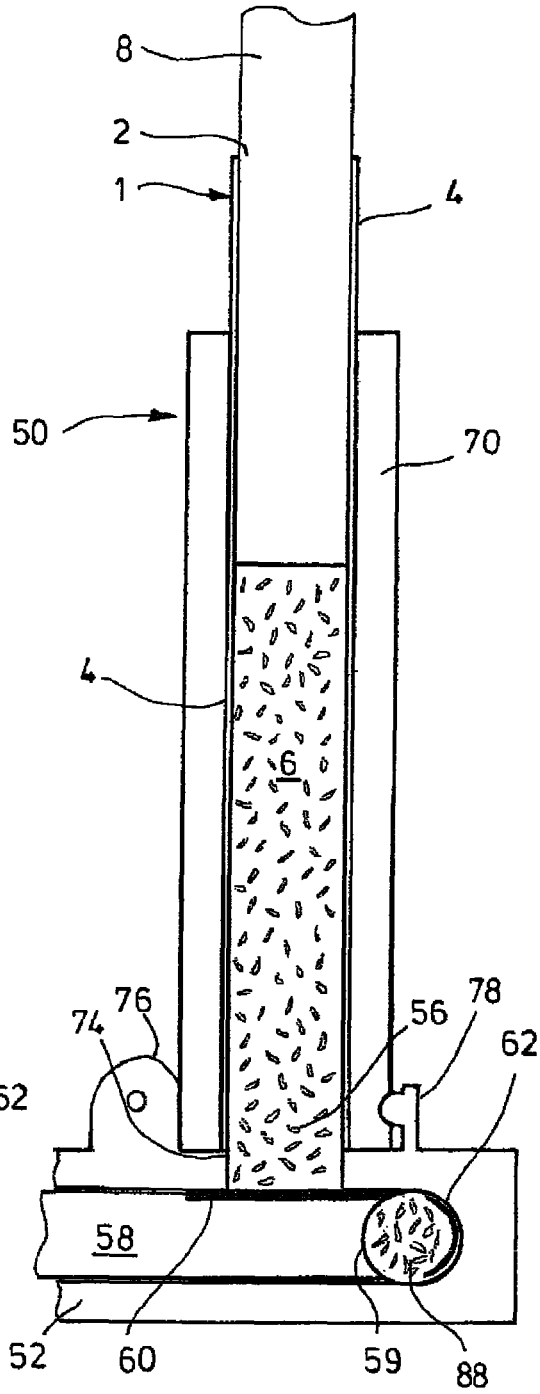
Figure 7A:
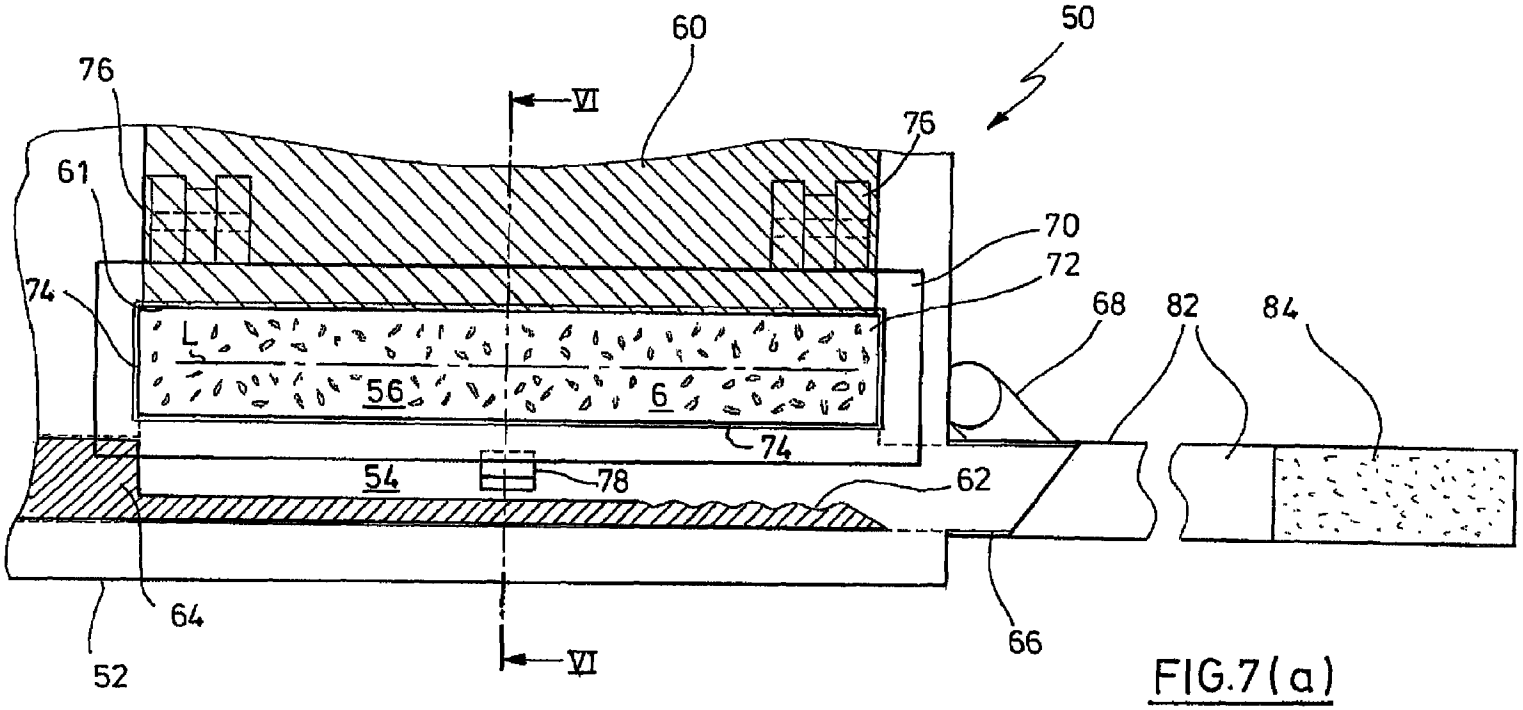
Figure 7B:
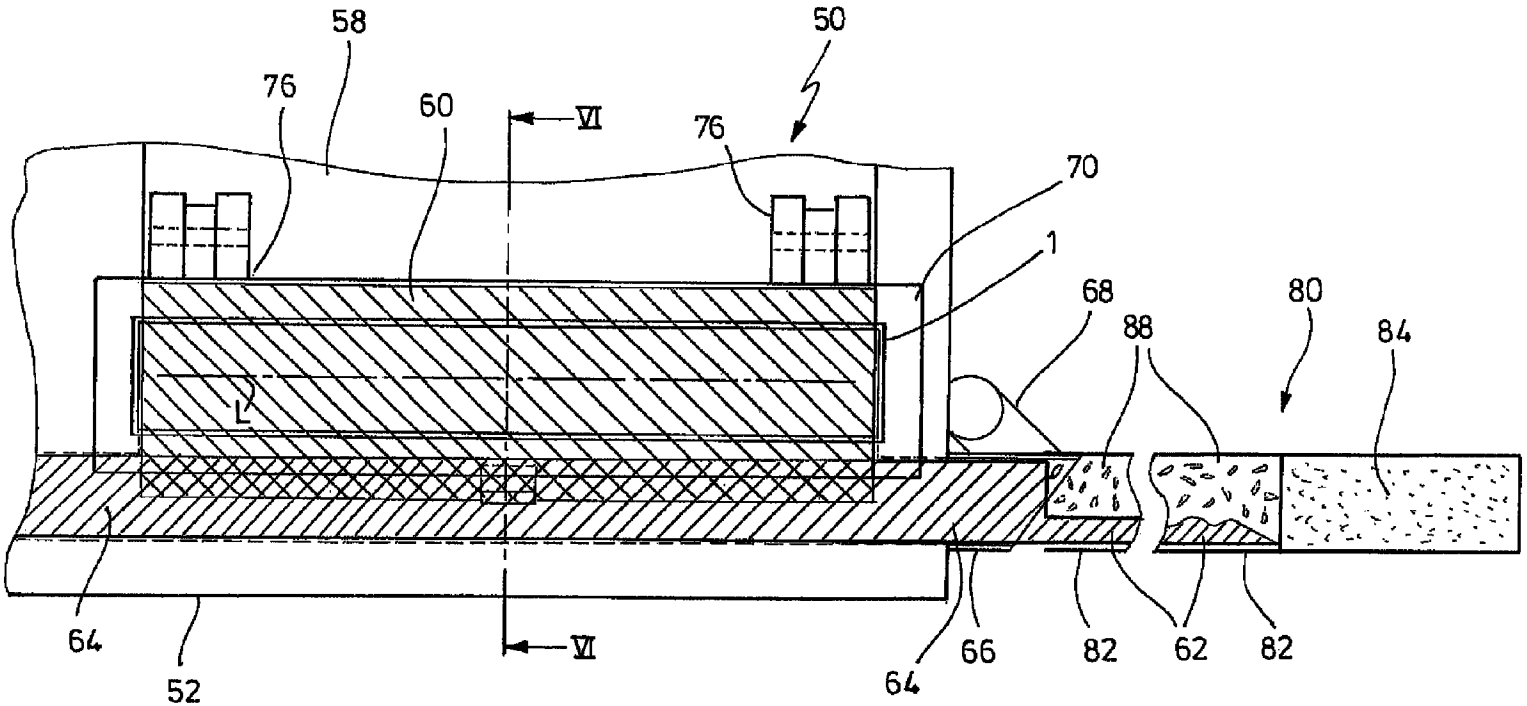

The invention will be explained in more detail hereinbelow with reference to exemplary embodiments. In the drawings:

FIG. 1 shows a schematic view of the principle of the system according to the invention for self-assembly of cigarettes, FIG. 2 shows a three-dimensional view of a first embodiment of a tobacco pack for the system according to the invention, FIG. 3 shows a three-dimensional view of a second embodiment of a tobacco pack for the system according to the invention, FIG. 4 shows a three-dimensional view of a third embodiment of a tobacco pack for the system according to the invention, FIG. 5 shows a three-dimensional view of a double pack, which contains two tobacco packs for the system according to the invention, FIG. 6 shows a schematic partial cross section through an embodiment of a stuffing device which is intended for the system according to the invention for self-assembly of cigarettes and has a tobacco pack inserted, to be precise part (a) showing the state prior to a cigarette strand being formed and part (b) showing the state once the cigarette strand has been formed and FIG. 7 shows a schematic partial plan view of the stuffing device according to FIG. 6 with an illustration of parts arranged in different planes, to be precise part (a) showing the state prior to a cigarette strand being formed and part (b)

showing the state once the cigarette strand has been formed and transferred into a cigarette-paper tube.

DETAILED DESCRIPTION OF THE PREFERRED EMBODIMENTS

FIG. 1 uses a schematic illustration to depict the functional principle of the system for self-assembly of cigarettes.

A cuboidal tobacco pack 1 with a first end side 2 and a second end side 3, and sides 4 located between the two end sides 2, 3, is filled with tobacco 6, to be precise preferably with fine-cut tobacco. This tobacco pack 1 serves, on the one hand, for storing the tobacco 6 but also, on the other hand, as a magazine for a stuffing device.

In order to use the tobacco pack 1 with the stuffing device, which will be explained in detail hereinbelow, removal of the second end side 3 of the tobacco pack is followed by the latter being inserted carefully into a holder of the stuffing device so that no tobacco 6 falls out of the tobacco pack 1, and thereafter the first end side 2 is removed. With the aid of a slide 8, which is a component of the stuffing device, the tobacco 6 can then be forced out of the tobacco pack 1 via the second end side 3, to be precise into a pressing chamber of the stuffing device, in order to be formed into a tobacco strand and transferred into a cigarette-paper tube.

This procedure can be repeated until the slide 8 arrives at the second end side 3 of the tobacco pack 1 and the tobacco pack 1 is empty.

FIG. 2 shows an embodiment of a tobacco pack 10 which, closed on all sides, is produced from cardboard. The tobacco pack 10 is cuboidal and has two end sides, the first end side 12 and the second end side 13, and four sides 14 arranged between the end sides 12, 13. The first end side 12 serves as a first covering 16 and the second end side 13 serves as a second covering 17. The first covering 16 is connected to the other sides 14 via a perforation line 18 and the second covering 17 is connected to the other sides 14 via a perforation line 19. The perforation lines 18 and 19 mean that the two coverings 16 and 17, respectively, are easy to remove, in order for the tobacco pack 10 thus to be opened on the first end side 12 and on the second end side 13. In order to make it easier for the first covering 16 and the second covering 17 to be pulled off, pulling lugs may be provided on the first covering 16 and/or the second covering 17, or the perforation lines 18, 19 may have indents, notches or points of engagement, in order to facilitate the initial tearing-open operation (not depicted in FIG. 2).

In the case of that embodiment of a tobacco pack which is illustrated in FIG. 3, and is designated here by 20 and, once again, is cuboidal, the first end side 22 and the second end side 23 of the basic body of the tobacco pack 20, the basic body being formed from the four sides 24, are open. In the exemplary embodiment, this basic body is produced from cardboard. The first covering 26 and the second covering 27 are in the form of sheet-material inserts, as indicated by the dashed lines, which, in the exemplary embodiment, are produced from aluminum. In order for the tobacco pack 20 to be opened on the first end side 22 and the second end side 23, the first covering 26 and the second covering 27 can be pulled out of the basic body, which is formed by the four sides 24.

The embodiment of a tobacco pack 30, which is shown in FIG. 4, is likewise cuboidal and has a first end side 32, a second end side 33 and a basic body formed from the four sides 34 located therebetween. This basic body is open on the first end side 32 and on the second end side 33. The covering for the end sides 32, 33 is in the form of outer packaging or a wrapper 36 which, in the exemplary embodiment, consists of a thin, transparent film. In order for it to be possible to remove the wrapper, a tearing strip 37 is provided, and this subdivides the wrapper 36 into a top part 38 and a bottom part 39. In this way, the top part 38 of the wrapper 36 forms the covering of the first end side 32, while the bottom part 39 serves as the covering of the second end side 33.

Once the wrapper 36 has been torn open with the aid of the tearing strip 37, in the first instance the bottom part 39 of the wrapper 36 can be removed very easily, in which case the tobacco pack 30 can be inserted into a holder of a stuffing device with the second end side 33 in front, without pieces of tobacco escaping out of the tobacco pack 30 in the process. The top part 38 of the wrapper 36 can then be pulled away in the upward direction.

Mixed forms of the exemplary embodiments according to FIGS. 2, 3 and 4 are likewise conceivable, e.g. a tobacco pack in which the first covering is made of cardboard and can be removed via a perforation line, while the second covering comprises a pushed-in sheet-material insert. Furthermore, it is also possible, in the case of the exemplary embodiments according to FIGS. 2 and 3, to provide additional outer packaging or an additional wrapper, in a manner similar to the wrapper 36 according to FIG. 4.

Cardboard or paperboard, in particular, is a suitable material for the tobacco pack or the basic body of the tobacco pack, but it is also possible to use other materials, e.g. plastic or metals (e.g. aluminum foil) and composite materials. It is advantageous for the insides to have a coating which reduces the friction between the pack material and the tobacco, e.g. a coating with polyethylene or polypropylene. In the exemplary embodiments according to FIGS. 2, 3 and 4, such a coating is provided on the insides of the sides 14, 24 and 34. Such a coating may also have diffusion-inhibiting properties, in order to maintain the tobacco moisture in the pack. As an alternative, an additional diffusion-inhibiting coating is possible.

The system for self-assembly of cigarettes functions particularly well if (see FIG. 1) the tobacco 6 exiting on the second end side 3 of the tobacco pack 1 does not block up as it is introduced into a stuffing device. The dimensions of the second end side 3 of the tobacco pack 1 are therefore preferably adapted essentially to the dimensions of the introduction opening of the stuffing device. Since the width of this introduction opening is preferably somewhat greater than the diameter of a cigarette, whereas the length of the introduction opening essentially corresponds to the length of the tobacco strand in a cigarette, the second end side 3 of the tobacco pack 1 thus has essentially the length of a cigarette or the tobacco strand of a cigarette, while its width (thickness of the tobacco pack 1) is somewhat greater than a cigarette diameter. In the case of preferred embodiments, the tobacco pack 1 is therefore relatively narrow, i.e. it is not very thick.

FIG. 5 illustrates a double pack 40, which has outer packaging 42, which is made of cardboard and has a hinge lid 44, and contains two tobacco packs 46 and 47. These tobacco packs 46 and 47 are constructed as has been explained above and are configured, for example, like the tobacco pack 10, 20 or 30. Since the tobacco packs 46 and 47 are thin or narrow, the outer packaging 42 can accommodate two such tobacco packs and has dimensions which essentially correspond to those of a conventional cigarette box. Following removal of the first tobacco pack 46 and of the second tobacco pack 47, the outer packaging 42 can be used, for example, for storing the cigarettes made with the system for self-assembly of cigarettes.

FIGS. 6 and 7 will be used to explain, hereinbelow, how one embodiment of the stuffing device of the system functions and interacts with a tobacco pack of the type described.

FIG. 6 illustrates a schematic partial cross section of the stuffing device, designated by 50, along line VI-VI from FIG. 7. A tobacco pack 1 has been inserted into the stuffing device 50.

The stuffing device 50 has a base 52, which contains a pressing chamber 54 in the form of a cavity. The pressing chamber 54 is oriented in a longitudinal direction L, see FIG. 7. In its top region, the pressing chamber 54 is accessible via an introduction opening 56 which, in the exemplary embodiment, extends over the entire length of the pressing chamber 54 and is somewhat wider than the diameter of a conventional cigarette.

On one side (the left-hand side in FIG. 6), the pressing chamber 54 is bounded by a pressing bar 58 with a concave surface 59. The pressing bar 58 is mounted such that it can be displaced transversely to the longitudinal direction L, as is indicated by the arrow in FIG. 6(*a*).

A cutting blade 60 with a cutting edge 61 is arranged on the top side of the pressing bar 58, to be precise, in the exemplary embodiment, it is fixed on the pressing bar 58. The cutting blade 60, like the pressing bar 58, extends over the entire length of the pressing chamber 54. In the exemplary embodiment, the pressing bar 58 consists of plastic and the cutting blade 60 consists of steel. Depending on material selection, however, it is also conceivable for the pressing bar and cutting blade to be formed in one piece.

Arranged opposite the pressing bar 58 is a tongue 62 which is formed in a channel-like manner and has a concave surface 63. The tongue 62 is mounted in a longitudinally displaceable manner and is fitted on a ram 64, which forms the rear termination of the pressing chamber 54 when the tongue 62 has been pulled all the way back, see FIG. 7(*a*). The tongue 62 likewise extends over the entire length of the pressing chamber 54. In the exemplary embodiment, it has a number of teeth in the vicinity of its front end.

As FIG. 7 shows, an attachment neck 66, which in the exemplary embodiment is beveled slightly, is arranged upstream of the pressing chamber 54. A clamp 68 is located alongside the attachment neck 66 and is spring-mounted in relation to the same.

On the top side of the base 52, a holder 70 is arranged above the introduction opening 56. The holder 70 forms a shaft 72, into which the tobacco pack 1 can be inserted with its second end side 3 in front. The shaft 72 is slightly wider than the introduction opening 56, in which case a protrusion 74 is formed at its bottom end, along the edge of the introduction opening 56. The protrusion 74 serves as a bottom stop for the tobacco pack 1. In the exemplary embodiment, the length of the holder 70, measured in the longitudinal direction L, is approximately equal to the length of the pressing chamber 54.

In the exemplary embodiment, the holder 70 can be pivoted in relation to the base 52. For this purpose, two articulations 76 are located on one side, in the bottom region of the holder 70, while a latching means 78 is provided on the opposite side, in order for the holder 70 to be arrested in the erected state (use state) shown in FIG. 6. Once the latching means 78 has been released, the holder 70 can be pivoted through approximately 90° in the direction of the base 52. This is beneficial in order to save space as the stuffing device 50 is being transported.

In order to assemble cigarettes using the stuffing device 50 and the tobacco 6 contained in the tobacco pack 1, in the first instance the covering on the second end side 3 of the tobacco pack 1 is removed. The second end side 3 here should not be held in the downward direction in order to prevent any pieces of tobacco from escaping. The tobacco pack 1 is then inserted into the shaft 72 with its second end side 3 in front, and is advanced up to the protrusion 74. In the exemplary embodiment, the height of the holder 70 is less than the length of the tobacco pack 1, in which case the tobacco pack 1 projects at the top end of the shaft 72 and can easily be removed again at a later stage.

If appropriate, the stuffing device 50, which in the exemplary embodiment is of lightweight design, can be tilted slightly by the user as the tobacco pack 1 is inserted, in order that tobacco does not fall out of its second end side 3. Once the tobacco pack 1 has been oriented as is shown in FIG. 6, it is also possible for the covering on the first end side 2 to be removed without any risk of contamination.

With the aid of the slide 8, which in the exemplary embodiment is adapted to the cross section of the tobacco pack 1, the tobacco 6 can be advanced downward until it enters into the pressing chamber 54, through the introduction opening 56, and reaches the floor there. This state is illustrated in FIG. 6(*a*).

When he wishes to make a cigarette 80, the user, in the first instance, plugs a cigarette-paper tube 82 with a filter 84 onto the attachment neck 66. The cigarette-paper tube 82 here is secured by the clamp 68.

Next, the user operates the actuating mechanism of the stuffing device 50, this mechanism not being illustrated specifically in the figures. As a result, in the first instance the pressing bar 58 is advanced in the direction of the arrow. The cutting blade 60, which is moved along in the process, severs the tobacco 6 along the line 86, in which case the tobacco which has entered into the pressing chamber 54 is guided toward the tongue 62 by the pressing bar 58. The concave surfaces 59 and 63 here form a tobacco strand 88, the diameter of which corresponds to that of a cigarette. In the illustration according to FIG. 6(*b*), the pressing bar 58 has reached its end position. The tobacco strand 88 has been completed, it being possible for the tobacco to be compressed to some extent in comparison with the tobacco 6 in the tobacco pack 1.

Thereafter, brought about automatically by the actuating mechanism in the stuffing device 50, the ram 64 and the tongue 62, which is fastened thereon, are advanced in the longitudinal direction L, that is to say to the right in the illustration according to FIG. 7. The tongue 62 carries along the tobacco strand 88 in the process and transports it through a lead-through in the base 52 at the front end of the pressing chamber 54, and through the attachment neck 66, into the cigarette-paper tube 82. During this operation, the front end of the tobacco strand 88 has already reached the filter 84 before the tongue 62 ceases moving, in which case, as the tongue 62 continues moving, the cigarette-paper tube 82 detaches itself from the attachment neck 66. FIG. 7(*b*) shows a state just before the self-assembled cigarette 80 is removed from the attachment neck 66.

Once the cigarette 80 has been completed, the movement sequence of the actuating mechanism in the stuffing device 50 is reversed. In this case, the tongue 62 pulls all the way back again into the pressing chamber 54, and the pressing bar 58 moves to the left, in the illustration according to FIG. 6, as far as the stop, in which case the initial state, which is shown in FIG. 6(*a*), is reinstated. The user can then force tobacco 6 into the pressing chamber 54 again, with the aid of the slide 8, in order to assemble a further cigarette.

The figures do not illustrate the detailed construction of the actuating mechanism of the stuffing device 50. A person skilled in the art, however, will be capable of using the movement sequence explained to design such a mechanism. A comparable design is disclosed in U.S. Pat. Nos. 2,731,971, 3,127,900 and 4,411,278. The actuating element used in these cases is a pivoting lever. A single pivoting movement allows the user to displace the pressing bar and then advance the tongue.

In order to check whether a given sample of fine-cut tobacco has short fibers to the extent where a proportion of more than 20% by weight has a fiber length of less than 2 mm, use can be made of the following screening method:

A sample of approximately 40 g of the fine-cut tobacco is screened (with the conventional level of moisture for packed fine-cut tobacco being maintained) using a set of five screens which are arranged one above the other and, going from top to bottom, meet the following specifications: ISO 3310-2 rotary screens with nominal sizes 31.5 mm, 13.2 mm and 4.0 mm and ISO 3310-1 woven-wire screens with nominal sizes 2.0 mm and 1.0 mm. The lowermost termination is formed by a flat tray, which accommodates the screens inserted one above the other and one inside the other. The screening equipment used is, for example, the "KS 1000" from Retsch, set to a stirring speed of 90 on the scale and a duration of three minutes. Immediately following the screening operation, the fractions remaining on the screens and the fraction which has passed onto the bottom tray are weighed. In order to achieve better statistics, it is possible to execute the screening, for example, with five samples and to determine the average percentage distribution over the individual screening fractions. The proportion with a fiber length of less than 2 mm can be found from the fractions on the lowermost screen and on the bottom tray, in relation to the sum of all the fractions.

The invention claimed is:

1. A system for self-assembly of cigarettes, said system comprising:

a stuffing device; and a tobacco pack, said tobacco pack presenting a first end side and a second end side, said first end side including a removable first covering adapted for removal, said second end side including a removable second covering adapted for removal, said tobacco pack being filled with tobacco, said stuffing device including a pressing chamber presenting a longitudinal direction, said pressing chamber being adapted to receive tobacco therein via a longitudinally oriented introduction opening, said stuffing device including a pressing bar adapted for movement transverse to the longitudinal direction of the pressing chamber to form the tobacco into a tobacco strand, said stuffing device including a pushing-action mechanism adapted for movement in the longitudinal direction of the pressing chamber for transferring the tobacco strand out of the pressing chamber and into a cigarette-paper tube arranged downstream of the pressing chamber, said stuffing device further including a holder into which the tobacco pack is adapted to be inserted with the second end side of the tobacco pack in front such that, in the inserted state, the second end side of the tobacco pack is arranged above the introduction opening of the pressing chamber.

2. The system as claimed in claim 1, said stuffing device including a moveable cutting element arranged along the introduction opening of the pressing chamber such that movement of the cutting element severs tobacco penetrating through the introduction opening and closes the introduction opening.

3. The system as claimed in claim 2, said cutting element and said pressing bar being operably coupled for corresponding movement.

4. The system as claimed in claim 3, said stuffing device including a moveable actuating element operatively connected, via an actuating mechanism, to the cutting element, the pressing bar, and the pushing-action mechanism, said moveable actuating element being adapted to cooperate with the cutting element to sever tobacco penetrating through the introduction opening, said moveable actuating element being adapted to cooperate with the pressing bar to form the tobacco located in the pressing chamber into a tobacco strand, said moveable actuating element being adapted to cooperate with the pushing-action mechanism to transfer the tobacco strand into a cigarette-paper tube arranged upstream of the pressing chamber.

5. The system as claimed in claim 1, said cigarette-paper tube being configured to plug onto an attachment neck arranged on the stuffing device upstream of the pressing chamber.

6. The system as claimed in claim 1, said pushing-action mechanism including a tongue arranged opposite the pressing bar, said tongue being configured in a channel-like manner and extending over the length of the pressing chamber.

7. The system as claimed in claim 1, said stuffing device including a slide, said slide being configured for insertion, via the first end side of the tobacco pack into the holder to push into the tobacco pack for advancing the tobacco in the tobacco pack.

8. The system as claimed in claim 7, said slide being configured as a weight.

9. The system as claimed in claim 7, said slide being insertable into the stuffing device and having an accommodating space for the tobacco pack, said slide being configured as a drawer for selective insertion into and removal from the stuffing device.

10. The system as claimed in claim 7, said slide being provided with markings such that, when the slide is pushed into the tobacco pack, the residual quantity of tobacco contained in the tobacco pack is readable.

11. The system as claimed in claim 1, said holder being pivotally mounted on the stuffing device for pivotal movement between a horizontal loading position and a use state, said use state including the second end side of the tobacco pack being inserted into the holder and arranged above the introduction opening of the pressing chamber.

12. The system as claimed in claim 1, said stuffing device including a closure mechanism moveable between a closed state and an open state, said closure mechanism covering the second end side of the tobacco pack inserted into the holder when the closure mechanism is in the closed state.

13. The system as claimed in claim 1, said holder including a shaft into which the tobacco pack is adapted to be inserted with the second end side of the tobacco pack disposed in front.

14. The system as claimed in claim 13, said shaft defining a height that is less than the length of the tobacco pack inserted into the shaft.

15. The system as claimed in claim 1,
said tobacco pack presenting a cuboidal basic shape.
16. The system as claimed in claim 1,
said first covering, said second covering, or both the first and second coverings being connected via predetermined tearing points to sides of the tobacco pack,
said predetermined tearing points being located between the first end side and the second end side.
17. The system as claimed in claim 16,
said predetermined tearing points including at least one perforation line.
18. The system as claimed in claim 1,
said tobacco pack including a body containing cardboard,
said body being open on the first end side, on the second end side, or on both the first and second end sides,
said first or second covering being a foil-material insert which is pushed into the body.
19. The system as claimed in claim 1,
said tobacco pack including a friction-reducing coating on the inside of the pack.
20. The system as claimed in claim 1,
said tobacco pack including a diffusion-reducing coating on the inside of the pack.
21. The system as claimed in claim 1,
said tobacco pack including outer packaging.
22. The system as claimed in claim 1,
said tobacco pack including a body and outer packaging,
said body being open on the first end side, on the second end side, or on both the first and second end sides,
said outer packaging comprising the first covering, the second covering, or the first and second coverings.
23. The system as claimed in claim 21,
said outer packaging being configured for storing cigarettes made using the system.
24. The system as claimed in claim 23,
said outer packaging including a hinge lid.
25. The system as claimed in claim 1,
said tobacco in the tobacco pack being pre-divided.
26. The system as claimed in claim 25,
said tobacco in the tobacco pack comprising a block,
said block including a predetermined weakening point disposed parallel to the second end side.
27. The system as claimed in claim 1,
said tobacco in the tobacco pack comprising short fibers such that a proportion of more than 20% by weight of the tobacco has a fiber length of less than 2 mm.
28. The system as claimed in claim 1,
said tobacco pack presenting a thickness that is 1 to 1.5 times the width of the introduction opening in the stuffing device,
said thickness of the tobacco pack being at least slightly greater than the width of the introduction opening,
said tobacco pack butting against a protrusion over the introduction opening when the tobacco pack is inserted into the holder.
29. The system as claimed in claim 28,
said system further including a second tobacco pack,
said tobacco pack and said second tobacco pack having common outer packaging.
30. The system as claimed in claim 1,
said tobacco pack presenting a tobacco pack chamber extending continuously from the first end side to the second end side.

* * * * *